US006843867B1

(12) United States Patent
Foerster et al.

(10) Patent No.: US 6,843,867 B1
(45) Date of Patent: Jan. 18, 2005

(54) METHOD OF AUSTEMPERING STEEL PARTS

(75) Inventors: Lothar Foerster, Stuttgart (DE); Michael Michalski, Weil der Stadt (DE); Andreas Becht, Ludwigsburg (DE); Karl-Otto Englert, Gundelsheim (DE); Michael Czeringer, Korntal-Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 182 days.

(21) Appl. No.: 10/169,444

(22) PCT Filed: Oct. 18, 2000

(86) PCT No.: PCT/DE00/03668

§ 371 (c)(1),
(2), (4) Date: Oct. 4, 2002

(87) PCT Pub. No.: WO01/49888

PCT Pub. Date: Jul. 12, 2001

(30) Foreign Application Priority Data

Dec. 31, 1999 (DE) ..... 199 63 973

(51) Int. Cl.[7] ..... C22C 9/00
(52) U.S. Cl. ..... 148/663; 148/662; 148/637
(58) Field of Search ..... 148/637, 663, 148/662

(56) References Cited

U.S. PATENT DOCUMENTS 2,258,566 A 10/1941 Elmendorf et al.
5,628,045 A 5/1997 Lindner et al.

FOREIGN PATENT DOCUMENTS

EP 0 707 088 4/1996
EP 0 896 068 2/1999

OTHER PUBLICATIONS

E. Zimmerman, "Materials and Materials Testing", Herman Schroedel Verlag, 1962, pp. 38, 39 74–79.

*Primary Examiner*—Deborah Yee
(74) *Attorney, Agent, or Firm*—Kenyon & Kenyon

(57) ABSTRACT

A method of austempering of steel parts is described. The steel parts are initially austenitized and subsequently quenched to a start temperature which is higher than the martensite start temperature. Then the steel parts are subjected to a first isothermal holding at the start temperature for a first time period. Subsequently the steel parts are held for a second isothermal time period at a finish temperature which is higher than the start temperature. The method described is particularly well suited for rapid austempering of steel parts, a pure bainitic structure being achievable, and the core hardness of the steel parts obtained being settable via the start temperature, the finish temperature, the duration of the first time period, and the duration of the second time period.

18 Claims, 1 Drawing Sheet

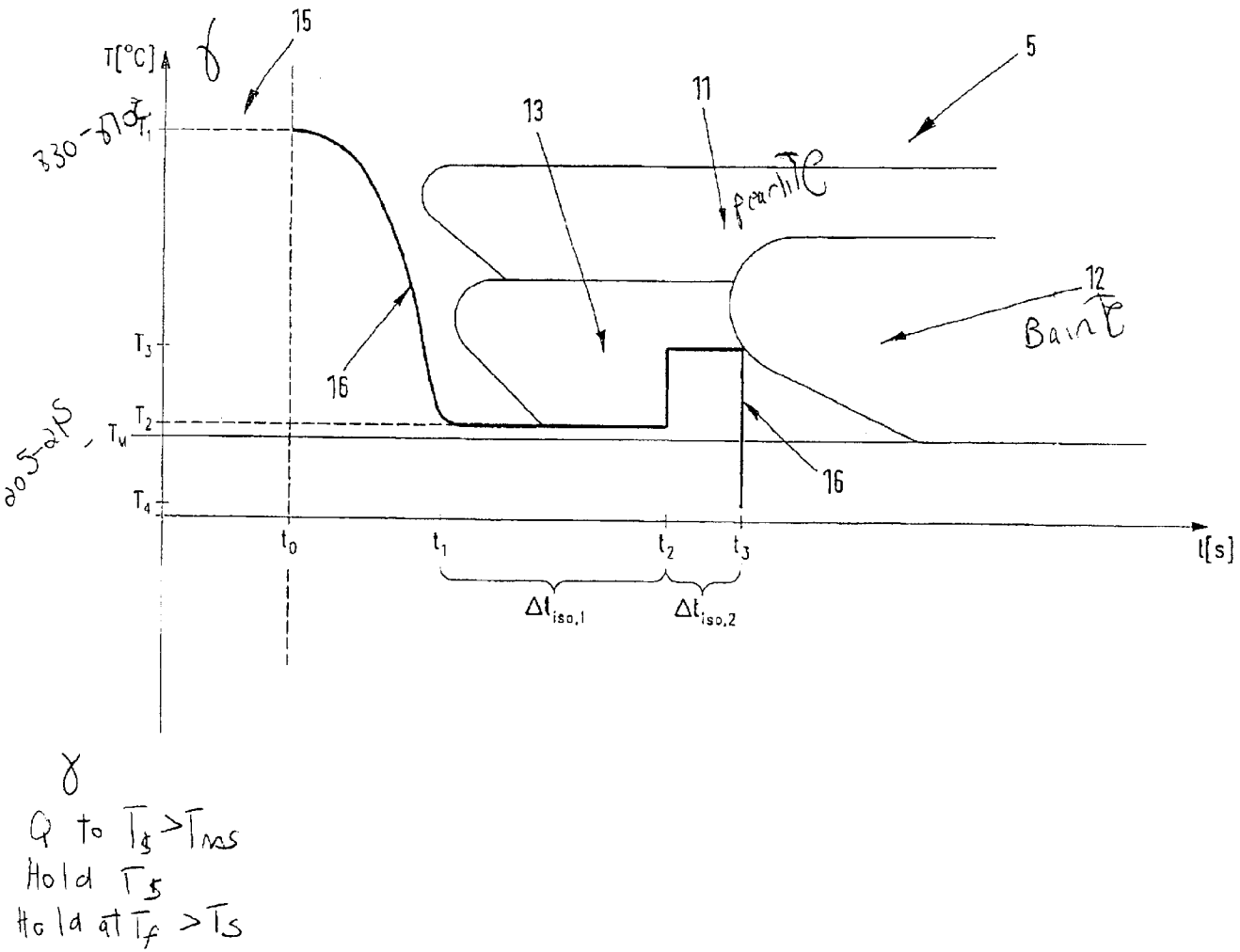
T[°C]
t[s]
5
11
12
13
15
16
16
$T_1$
$T_3$
$T_2$
$T_W$
$T_4$
$t_0$
$t_1$
$t_2$
$t_3$
$\Delta t_{iso,1}$
$\Delta t_{iso,2}$

METHOD OF AUSTEMPERING STEEL PARTS

FIELD OF THE INVENTION

The present invention relates to a method of austempering of steel parts

BACKGROUND INFORMATION

"Austempering" may be understood as a type of heat treatment for steel including initial "austenitizing," subsequent quenching to a temperature above the "martensite" start temperature, and holding the steel at this temperature for a specified time period.

With this procedure, which may also be referred to as "isothermal conversion" of austenite into bainite, it may be possible to obtain a steel which has fully or partially been converted from an austenitic into a bainitic structure to a degree that may be controllable depending on the objective and via temperature and holding time.

For further details on austenitizing and the above-explained austempering of steel, reference is made, for example, to E.

Zimmermann, "Materials and Materials Testing", Hermann Schrödel Verlag, 1962, pp. 38, 39, and 74–79.

Austenitization of steel, subsequent quenching and isothermal conversion of austenite into bainite above the martensite start temperature is described, for example, in U.S. Pat. No. 5,628,045.

Austempering of previously austenitized steels has previously been performed in baths referred to as hot salt baths. For this purpose, steel may be continuously held in this hot salt bath after quenching from the beginning of the bainite conversion (referred to as bainite start) to the end of the bainite conversion (referred to as bainite finish) at a constant temperature and for an appropriate, suitably selected holding time.

Furthermore, the steel to be austempered may be converted, after the elapse of a certain holding time in the hot salt bath, in a holding furnace operated using circulating air to achieve full conversion from austenite to bainite. The holding furnace used for this purpose may have the same temperature as the hot salt bath.

SUMMARY

An example method according to the present invention for austempering of steel parts may allow at least almost full conversion of austenite into bainite, i.e., a purely bainitic structure, to be achieved, while at the same time the hardness of the steel parts obtained may be controllable in a simple manner via the method parameters. In particular, the steel parts obtained may have improved strength characteristics, for example, improved pulsating compression fatigue strength.

An example method according to the present invention may allow the time previously required for converting austenite into bainite to be considerably shortened. Thus, considerable cost may be obtained in performing the example method according to the present invention.

An example method according to the present invention may be easily applicable to mass production without substantial modifications to the existing manufacturing process or investments in the manufacturing facilities being necessary.

Furthermore, the example method according to the present invention may allow batches of steel parts to be quenched at low salt bath temperatures, while relatively pure bainite is obtained, i.e., without a continuous bainite component, while also a uniform quenching intensity may be achieved within a batch. In particular, by selecting the start temperature $T_2$, which may be slightly higher than the martensite start temperature $T_M$, the steel may be prevented from going through the perlite structure region in the TTT chart during quenching.

The core hardness of the steel parts obtained after performing the example method according to the present invention may be settable by the duration of the first time period, i.e., the holding time in the first hot salt bath or oil bath, as well as by the temperature of the first hot salt bath. In general, the shorter the selected holding time in the first hot salt bath, the lower the core hardness of the bainitic structure of the steel parts obtained.

The same may apply to the conversion of the steel parts in a holding furnace by a circulating-air principle or in a second salt bath having a higher temperature for the second time period. Also in this case, the core hardness of the, for example, purely bainitic structure obtained of the steel parts may be a function of the finish temperature and the duration of this second time period.

The conversion of an austenitic structure into a bainitic structure being an exothermal reaction, the reaction heat produced may be used for heating the steel parts after the elapse of the first time period from a start temperature $T_2$ to a finish temperature $T_3$, at which the steel parts may then be held for the duration of the second time period. Thus, energy may be saved, and the steel parts may be quickly and uniformly heated.

BRIEF DESCRIPTION OF THE DRAWING

The FIGURE illustrates a schematic sketch of a TTT (time-temperature-transformation) chart of the austenite to bainite conversion in various stages.

DETAILED DESCRIPTION

The present invention is explained using the example of austempering of a type 100Cr6 steel, material No. 1.3505.

To do so, parts made of steel of this type are austenitized in a conventional manner and subsequently quenched from a quenching temperature $T_1$ of 830° C. to 870° C., for example, at 850° C. in a conventional manner in a first hot salt bath to a start temperature $T_2$, which is higher than martensite start temperature $T_M$ of the steel parts. In the present example, martensite start temperature $T_M$ is approximately 205° C. to 215° C.

This is explained with reference to the figure, which shows in a TTT chart 5 that the steel is initially present as austenite in an austenite structure region 15, and at time $t_0$ it is quenched from quenching temperature $T_1$ to start temperature $T_2$ within a time period of typically 5 s to 15 s. At time $t_1$, first time period begins and lasts for an interval of $\Delta t_{iso,1}$, during which the steel, i.e., the steel parts, are held in a first hot salt bath in a conventional manner at an at least approximately constant start temperature $T_2$. Instead of the hot salt bath, an oil bath may also be used.

In TTT chart 5, it is also shown that during first period $\Delta t_{iso,1}$ the austenite initially present in austenite structure region 15 begins to convert into bainite. This beginning of bainitization occurs as soon as transformation curve 16 shown in the TTT chart, which represents the variation over time of the temperature used in the example method according to the present invention, enters bainite transformation region 13.

The conversion of austenite into bainite is completed as soon as transformation curve 16 in TTT chart 5 reaches bainitic structure region 12, where the steel parts have a purely bainitic structure.

Perlitic structure region 11, which is not entered during the austempering method by thermal conversion in stages according to the present invention, is also shown in TTT chart 5.

After isothermal holding of the steel parts at start temperature $T_2$ for first period $\Delta t_{iso,1}$ at time $t_2$ the hot salt bath is completed; subsequently the steel parts are held at an at least approximately constant finish temperature $T_3$, which is higher than start temperature $T_2$.

This second isothermal holding at finish temperature $T_3$ lasts for a second time period $\Delta t_{iso,1}$ which is completed as soon as the bainitic structure region 12 is reached at time $t_3$, i.e., as soon as an at least almost total conversion of austenite into pure bainite has occurred. Contrary to the representation in the figure and for reasons of process stability, for example, time period $\Delta t_{iso,2}$, i.e., time $t_3$, may also be selected or extended so that the coordinate ($t_3$, $T_3$) is within bainitic structure region 12. Reaching the boundary of bainitic structure region 12 in the figure during second time period $\Delta t_{iso,2}$ is therefore only to be understood as a minimum requirement for the length of second time period $\Delta t_{iso,2}$.

The second isothermal holding of the steel parts at finish temperature $T_3$ occurs in a second hot salt bath, for example, or an oil bath or, as an alternative, in a holding furnace, for example, in a holding furnace based on the circulating air principle.

After completion of the bainitic conversion in stages as described above, the steel parts obtained are removed, cooled, and cleaned by conventional methods.

In particular, in the example embodiment described above, after the steel parts have been austenitized, the treated batch is initially quenched in the first hot salt bath at a start temperature $T_2$ of 215° C. to 230° C. A temperature of 220° C. may be used, for example.

At this start temperature $T_2$, the steel parts are isothermally held in the first hot salt bath for first time period $\Delta t_{iso,1}$, which lasts between 5 min. and 30 min., e.g. 20 min.

Subsequently, at time $t_2$, the steel parts are converted in a holding furnace based on a circulating air principle, which has a finish temperature $T_3$ of 240° C. to 280° C., in particular 260° C. The steel parts are then held at this finish temperature $T_3$ for second time period $\Delta t_{iso,2}$ lasting between 200 min. and 400 min., such as, for example, between 250 min. and 270 min.

As an alternative, a second hot salt bath having finish temperature $T_3$ may also be used instead of a holding furnace.

According to an example embodiment of the method according to the present invention, the reaction heat generated iii the formation of the bainitic structure is used, at least in part, for heating the steel parts from start temperature $T_2$ to finish temperature $T_3$ or for heating the holding furnace.

The above-described example method may substantially shorten the overall bainitic conversion time to approximately 300 min. in the example embodiment described above.

Therefore, a time savings with respect to the conventional method, i.e., isothermal holding of the steel parts at start temperature $T_2$ until the pure bainitic structure may be achieved, for example, of about 60 minutes.

Finally, the steel parts produced, i.e. treated, using the above-described example method having a bainitic structure may have a reduced core hardness compared to the starting material of 650 HV10 to 700 HV10.

At the same time, the steel parts may have a substantially increased pulsating compression fatigue strength.

What is claimed is:

1. A method of austempering of steel parts, comprising the steps of:

(a) austenitizing the steel parts;

(b) quenching the steel parts to a start temperature which is higher than a martensite start temperature of the steel parts;

(c) at least approximately isothermally holding the steel parts at the start temperature for a first time period; and (d) at least approximately isothermally holding the steel parts at a finish temperature which is higher than the start temperature for a second time period;

wherein a core hardness of the austempered steel parts after the steps (a), (b), (c) and (d) are performed is reduced during performance of the steps (a), (b), (c) and (d) compared to the core hardness of the steel parts before the steps (a), (b), (c) and (d) are performed.

2. The method according to claim 1, wherein after the steps (a), (b), (c) and (d) are performed, the steel parts have a bainitic structure with a reduced core hardness compared to a starting material of 650 HV10 to 700HV10.

3. The method according to claim 1, further comprising the step of at least largely converting an austenitic structure of the steel parts into a pure bainitic structure.

4. The method according to claim 1, wherein the start temperature is between 215° C. and 230° C.

5. The method according to claim 1, wherein the finish temperature is between 240° C. and 280° C.

6. The method according to claim 1, wherein at least one of the quenching and the holding of the steel parts at the start temperature is performed in one of a first hot salt bath and an oil bath.

7. The method according to claim 1, wherein the holding of the steel parts at the finish temperature is performed in one of a furnace, a second hot salt bath, and an oil bath.

8. The method according to claim 7, wherein the furnace includes a circulating air furnace.

9. The method according to claim 1, wherein the first time period lasts from 5 minutes to 30 minutes.

10. The method according to claim 1, wherein the second time period lasts from 200 minutes to 400 minutes.

11. The method according to claim 1, wherein the second time period lasts from 250 minutes to 300 minutes.

12. The method according to claim 1, further comprising the step of cooling the steel parts to a temperature of 20° C. to 40° C. after holding the steel parts at the finish temperature.

13. The method according to claim 1, wherein the core hardness of the steel parts is set in accordance with at least one of a duration of at least one of the first and the second time period and at least one of the start temperature and the finish temperature.

14. The method according to claim 1, further comprising the step of at least partially using a reaction heat generated during the formation of the bainitic structure for heating the steel parts.

15. The method according to claim 14, wherein the reaction heat is used during the holding of the steel parts at the finish temperature which is performed in a furnace.

16. The method according to claim 14, wherein the reaction heat is used to raise a temperature of the steel parts from the start temperature to the finish temperature.

17. The method according to claim 1, wherein the first time period is shorter than the second time period.

18. The method according to claim 1, wherein the first time period lasts from 5 minutes to 30 minutes and the second time period lasts from 200 minutes to 400 minutes.

* * * * *

UNITED STATES PATENT AND TRADEMARK OFFICE

CERTIFICATE OF CORRECTION

PATENT NO. : 6,843,867 B1
DATED : January 18, 2005
INVENTOR(S) : Lothar Foerster et al.

It is certified that error appears in the above-identified patent and that said Letters Patent is hereby corrected as shown below:

Column 3,
Line 59, change "iii the formation" to -- in the formation --

Signed and Sealed this

Twelfth Day of July, 2005

JON W. DUDAS
*Director of the United States Patent and Trademark Office*